US006273283B1

(12) United States Patent
Terrana et al.

(10) Patent No.: US 6,273,283 B1
(45) Date of Patent: Aug. 14, 2001

(54) CLIP-ON BOTTLES

(76) Inventors: Frank P. Terrana, 213 Terrace Pl., New Milford, NJ (US) 07646; Antonio Terrana, 130 Overlook Ave. Apt. #15-G, Hackensack, NJ (US) 07601

( * ) Notice: Subject to any disclaimer, the term of this patent is extended or adjusted under 35 U.S.C. 154(b) by 0 days.

(21) Appl. No.: 09/537,285

(22) Filed: Mar. 29, 2000

(51) Int. Cl.[7] ..... B65D 1/02; B65D 23/00

(52) U.S. Cl. ..... 215/383; 215/399; 224/414

(58) Field of Search ..... 215/383, 399; 224/148.1, 148.5, 414

(56) References Cited

U.S. PATENT DOCUMENTS

| | | | |
|---|---|---|---|
| D. 196,390 | | 9/1963 | McDermott . |
| D. 199,643 | | 11/1964 | Roberts . |
| D. 204,702 | | 5/1966 | Nixon . |
| D. 246,156 | | 10/1977 | Muscatiello et al. . |
| 3,160,304 | | 12/1964 | Peacock . |
| 3,163,332 | | 12/1964 | Boyle et al. . |
| 3,225,951 | | 12/1965 | Poston et al. . |
| 3,716,871 | | 2/1973 | Borse . |
| 3,920,140 | * | 11/1975 | Kiser ..... 215/399 |
| 3,998,360 | * | 12/1976 | Mack ..... 215/383 X |
| 4,088,250 | | 5/1978 | Schaefer . |
| 4,176,770 | * | 12/1979 | Griggs et al. ..... 224/414 |
| 4,736,920 | | 4/1988 | Omessi . |
| 4,747,519 | | 5/1988 | Green et al. . |
| 4,925,042 | * | 5/1990 | Chong ..... 215/11.1 |
| 4,955,572 | | 9/1990 | Simmons . |
| 5,105,958 | | 4/1992 | Patton . |
| 5,251,577 | * | 10/1993 | McMahon ..... 224/414 |
| 5,609,277 | * | 3/1997 | McDonald ..... 224/148.3 |
| 5,743,620 | | 4/1998 | Rojas et al. . |

* cited by examiner

*Primary Examiner*—Sue A. Weaver

(57) ABSTRACT

A bottle, preferably made of plastic, includes a body of generally cylindrical external configuration and a clip joined to the body. The body has a closed lower end and an open upper end adapted to receive a cap. The clip is disposed within the cylindrical external configuration of the body and is spaced from a wall of the body by a slot having an open slot end disposed along the exterior of the bottle by which part of a support structure is insertable between the clip and the body wall to support the bottle upon the support structure.

20 Claims, 2 Drawing Sheets

CLIP-ON BOTTLES

BACKGROUND OF THE INVENTION

1. Field of the Invention

The present invention relates generally to bottles and, more particularly, to bottles having integrally formed clips allowing the bottles to be attached to various support structures.

2. Brief Discussion of the Related Art:

Plastic bottles have become extremely popular as containers for fluids and, in particular, beverages such as water, juice, soda, tea and milk. Typically, plastic bottles are generally cylindrical in configuration and thusly receivable in conventional cup holders such as those found in automobiles, in the armrests of chairs and various other places. Also, the generally cylindrical configuration of such bottles is compatible with conventional packaging formats where a plurality of bottles are held together by packaging structure, such as a carton or a plastic carrier, in the manner of a "six-pack ". A primary advantage of plastic bottles is that their caps can be removed and replaced so that the contents need not be consumed at one time but, rather, can be consumed over a period of time. Such bottles have additional advantages including being lightweight, relatively low in cost, recyclable, compatible with high volume manufacturing processes, and adaptable to diverse packaging structure, equipment and procedures. Plastic bottles have the further attribute of being transportable. However, transportability of conventional plastic bottles is limited in that the bottles must be physically carried from place to place by consumers. Often, consumers must hand carry and hold their bottles resulting in their hands being occupied and not free for other uses. Various reusable bottle carriers that can be worn by consumers have been proposed for plastic bottles. Such bottle carriers are relatively expensive and may not fit all sizes of conventional bottles. In addition, many products, such as beverages, sold in plastic bottles are often purchased spontaneously or in other situations where the purchasers do not have access to their bottle carriers thusly precluding their use in many circumstances.

It has been proposed to incorporate structure on bottles by which the bottles can be attached to or hung from various support structures as represented by U.S. Pat. Nos. 3,160,304 to Peacock, 3,163,332 to Boyle et al., 3,225,951 to Poston et al., 3,716,871 to Borse, 3,920,140 to Kiser, 4,747,519 to Green et al., 4,925,042 to Chong, 4,955,572 to Simmons, 5,105,958 to Patten, and 5,743,620 to Rojas et al. The Peacock, Boyle et al., Green et al., Chong and Simmons patents disclose bottles having clip or hook members formed separately from and not as part of the bottles. The Poston et al. and Patten patents disclose bottles having tongue structures for engagement in grooves or channels formed in or secured to the support structures to which the bottles are to be attached. The Borse, Kiser and Rojas et al. patents disclose bottles having clips formed integrally with bodies of the bottles and by which the bottles may be attached to or hung from support structures. The clips protrude exteriorly beyond external configurations of the bodies and are not designed to accommodate the contents with which the bottles are filled.

The need exists for clip-on bottles having bodies of generally cylindrical external configuration and clips formed integrally, unitarily with the bodies by which the bottles may be attached to or supported from various support structures, with the clips disposed within or defining part of the cylindrical external configuration of the bodies. The need further exists for clip-on bottles having bodies of generally cylindrical configuration and clips formed integrally, unitarily with the bodies, with the clips being hollow to receive the contents with which the bottles are filled.

OBJECTS AND SUMMARY OF THE INVENTION

Accordingly, it is a primary object of the present invention to overcome the aforementioned disadvantages of prior art clip-on bottles.

A further object of the present invention is to form a bottle of generally cylindrical external configuration with a clip disposed within the cylindrical external configuration of the bottle.

An additional object of the present invention is to form a bottle of generally cylindrical external configuration with a clip forming part of the cylindrical external configuration of the bottle.

The present invention also has as an object to form a bottle with a hollow clip having an interior for receiving the contents with which the bottle is filled.

It is also an object of the present invention to facilitate attachment of a plastic bottle to various diverse support structures.

Some of the advantages of the present invention are that the bottles can be easily transported by consumers while allowing consumers' hands to remain free for other uses, the plastic bottles can be easily attached to a person's clothing or accessories, the clips do not significantly reduce the available interior volume or capacity of the bottles, the clips do not add external profile to the bottles, the bottles are stylish and aesthetically appealing, the bottles are lightweight and cost-efficient, the bottles serve as effective advertising or sales tools for the contents thereof, the bottles may be of particular appeal to children, the bottles facilitate the avoidance of dehydration by enhancing accessibility to a source of fluid, the bottles are well-suited for retail display, and the bottles are adaptable to various conventional packaging formats including various packaging structures, equipment and/or methods.

These and other objects, advantages and benefits are realized with the present invention as generally characterized in a bottle including a body of generally cylindrical external configuration and a clip joined to the body. The body has a closed lower end and an open upper end adapted to receive a cap. The clip has an outer wall disposed within or defining part of the cylindrical external configuration of the body and an inner wall spaced from a wall segment of the body. A slot is defined between the inner wall of the clip and the wall segment of the body and has an open slot end disposed along the exterior of the bottle by which part of a support structure, such as a belt, waistband, backpack, stroller or shopping cart, for example, can be inserted between the clip and the bottle to support the bottle upon the support structure. The slot can be longitudinally curved or longitudinally straight and is preferably of uniform or substantially uniform depth. Preferably, the clip is hollow to define an interior communicating with the interior of the body so that contents with which the bottle is filled are disposed within the interior of the bottle and the interior of the clip.

Other objects and advantages of the present invention will become apparent from the following description of the preferred embodiments taken in conjunction with the accompanying drawings, wherein like parts in each of the several figures are identified by the same reference character.

DESCRIPTION OF THE PREFERRED EMBODIMENTS

Figure 1:
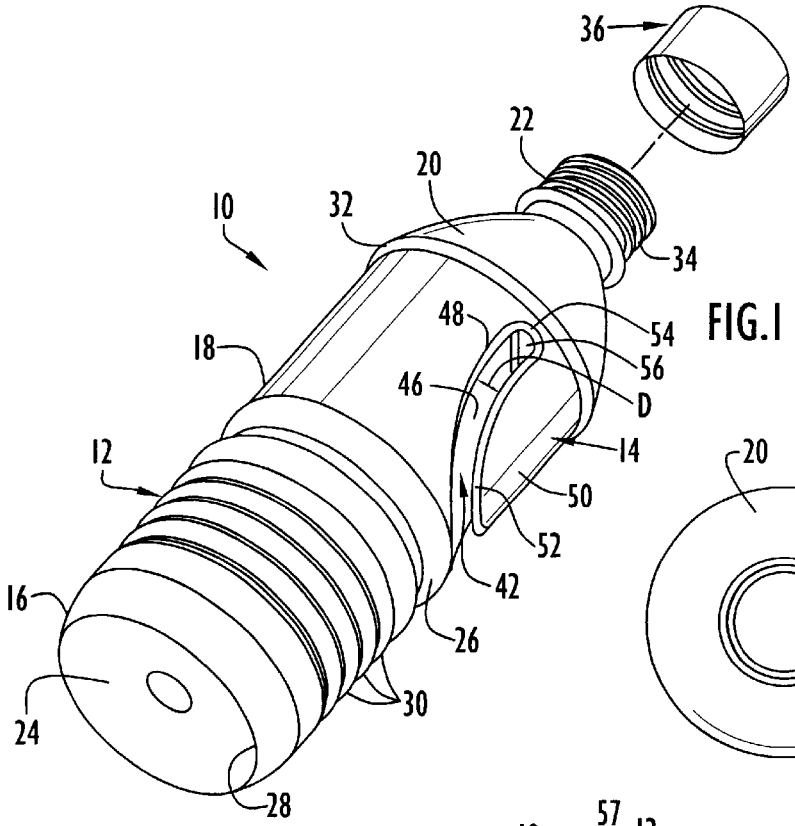
FIG. 1 is a perspective view of a bottle according to the present invention.
Figure 4:
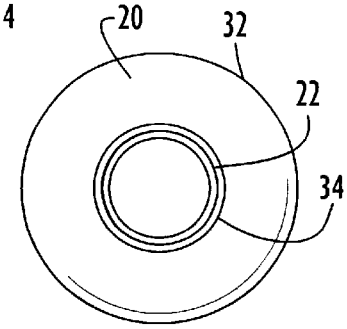
FIG. 4 is an end view of the bottle.

A plastic bottle 10 according to the present invention is illustrated in FIGS. 1–4 and includes a generally cylindrical body 12 and a clip 14 formed integrally, unitarily with body 12. The body 12 includes a lower or bottom section 16, an intermediate section 18, an upper or top section 20 and a neck 22. The lower section 16 is of generally cylindrical configuration between a bottom wall 24 of bottle 10 and a shoulder 26 at which the lower section is joined to the intermediate section. The bottom wall, which defines a closed lower end for the bottle, is centrally depressed in an upward direction forming an annular base 28 upon which the bottle may be supported vertically or in an upright position upon a support surface. A plurality of external annular ridges 30 are formed on the lower section to facilitate grasping of the bottle.

Figure 2:
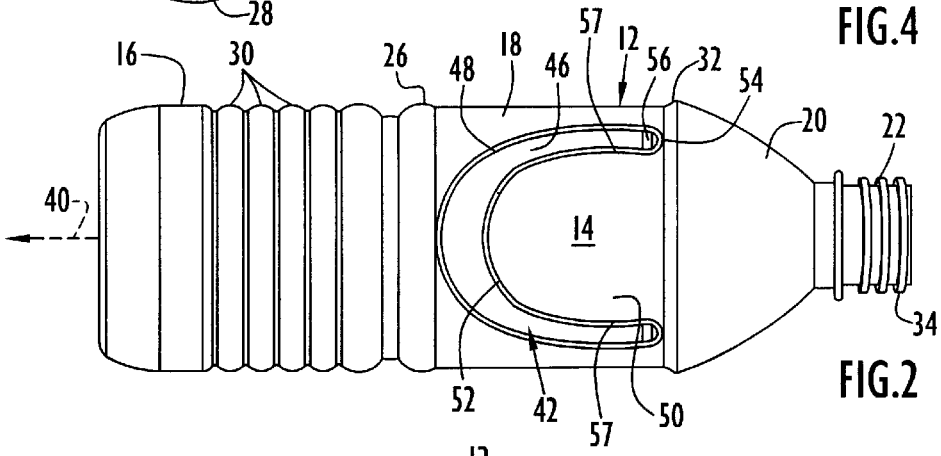
FIG. 2 is a side view of the bottle.

The intermediate section 18 is of cylindrical configuration with a uniform external diameter between shoulder 26 and a protruding rim 32 at which the intermediate section is joined to the upper section. The upper section 20 has a convex or dome-shaped configuration with a gradually decreasing external diameter between rim 32 and a lower end of neck 22. The neck 22 has a cylindrical configuration between the lower end thereof and an open upper end thereof defining an open upper end for the bottle by which access to the interior of the bottle is obtained. The neck carries an external thread 34 for engaging an internal thread of a cap, such as cap 36 shown in FIG. 1, used to close the open upper end of the bottle. The cap is removable and replaceable on the bottle by rotating the cap to engage and disengage the threads in a conventional manner. The neck is axially aligned with the upper portion, which is axially aligned with the intermediate and lower portions so that the bottle is symmetrical about its central longitudinal axis 40 as shown in FIG. 2.

Figure 3:
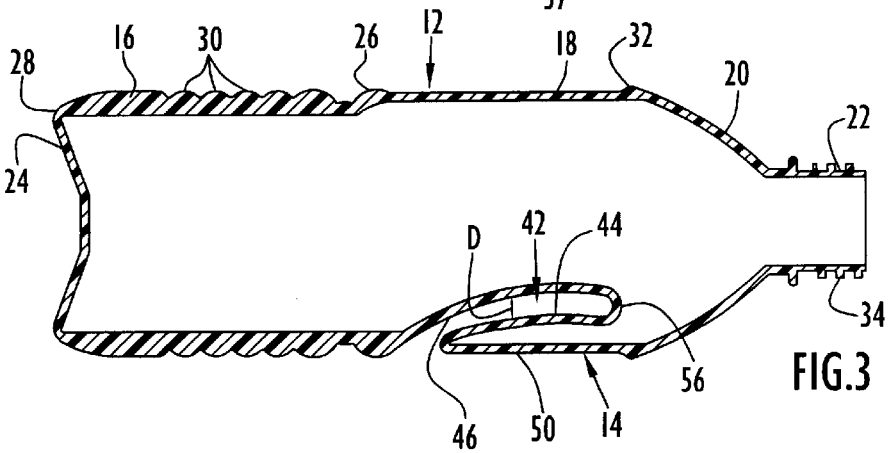
FIG. 3 is a side sectional view of the bottle.

The clip 14 is disposed on the intermediate section 18 and is spaced outwardly from the body 12 by a slot or recess 42 extending lengthwise from adjacent shoulder 26 to adjacent rim 32. The slot 42 has a depth D defined between an inner surface or wall 44 of clip 14 and an outer surface or wall segment 46 of body 12 as shown in FIG. 3. The wall segment 46 curves inwardly as shown in FIG. 3 and is joined to the outer cylindrical surface or wall of the intermediate section by an edge surface 48 following a U-shaped path as best shown in FIG. 2. The inner wall 44 of clip 14 follows the curvature of the wall segment 46 as shown in FIG. 3 and is joined to an outer surface or wall 50 of clip 14 by an edge surface 52 following a U-shaped path similar to that for edge surface 48 as shown in FIG. 3. The edge surface 52 is joined to the edge surface 48 by edge surfaces 54 disposed at opposite, upper ends of clip 14 and following a curved path. The inner wall 44 of the clip is joined to the wall segment 46 of the body by a curved surface 56 at a closed upper end of the slot. The clip 14 is centrally disposed between opposite sides of the wall segment 46, the wall segment having a width defined between the opposite sides thereof. The clip 14 has opposing sides 57 defined by opposite side segments of edge surface 52. The inner wall 44 and the outer wall 50 of clip 14 each extends laterally between sides 57. The slot 42 extends laterally from one side 57 to the other side 57. Accordingly, the slot 42 extends laterally the entire width of the clip 14.

The clip 14 is disposed within and does not extend beyond the cylindrical external configuration of the body 12. In the case of bottle 10, the outer wall 50 of the clip forms part of the cylindrical external configuration of the intermediate section 18. The outer wall 50 can thusly be curved to follow and complete the cylindrical external configuration of the intermediate section. The rim 32, which is slightly larger in external diameter than the intermediate section 18, defines the maximum external diametric dimension for bottle 10, and the outer wall 50 of the clip is disposed within or inside of the maximum external diametric dimension for the bottle. The slot 42 has an open lower end along the exterior of the bottle, the open lower end for slot 42 being adjacent the shoulder 26. The slot has a length between the open slot end, i.e. the open lower end, and the closed slot end, i.e. the closed upper end, and the slot is longitudinally curved between the open slot end and the closed slot end. The slot depth D, which corresponds to the distance that the inner wall 44 of the clip is spaced from the wall segment 46 of the bottle, is uniform or constant or substantially uniform or constant along the length of the slot and, therefore, along the length of the clip, as shown in FIG. 3. The distance D is minimized so as not to subtract significantly from the interior volume or capacity of the bottle while being large enough to receive a part or portion of a support structure to or from which the bottle is to be attached or supported. The clip 14 can be flexible or rigid, dependent on the material from which the bottle is formed, and can resiliently flex or bend to accommodate parts or portions of support structure larger than the dimension of depth D within the slot 42. The clip 14 is hollow as shown in FIG. 3 and defines an interior communicating and continuous with the interior of the body 12. Accordingly, when the bottle is filled with contents, such as a beverage, the interior of the clip as well as the interior of the body will be occupied by the contents thusly maximizing the volume or capacity.

Figure 5:
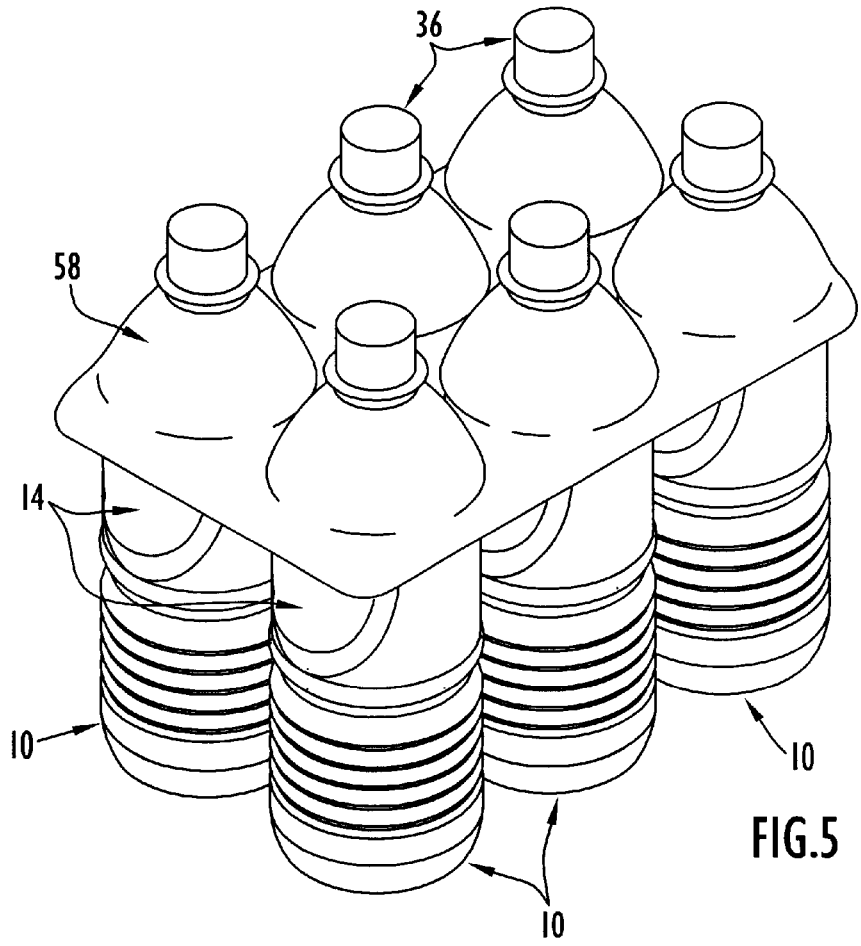
FIG. 5 is a perspective view illustrating a plurality of the bottles secured together by a packaging structure.

The bottle is preferably made integrally, unitarily as one piece of blow molded plastic or other suitable material. The bottle can be provided in various cylindrical sizes. FIG. 5 shows a plurality of bottles 10, namely six, packaged and held together by a conventional plastic package structure 58 in the manner of a "six-pack". Since the clips do not extend beyond the external cylindrical configuration of the bottles, the bottles can be arranged in close proximity for packaging and are thusly adaptable to conventional package structure as well as the equipment and/or methods utilized in conventional packaging.

A bottle 10 can be attached to or supported from various support structures as made possible by the clip 14. For example, the clip can be attached to a belt, waist band and other items of clothing, to backpacks, pocketbooks and other accessories carried by consumers, to baby carriages or strollers and/or shopping carts. Where products contained in the bottles are sold in grocery stores, the bottles can be suspended from the exterior of grocery carts thus increasing the room available in the grocery carts for other groceries. The clip is easily attached to various support structures by inserting some part or portion of the support structures within the slot 42 so that the surface 56 at the closed slot end is supported on the support structure. Also, the part or portion of the support structure can be frictionally retained between the clip and the body and/or the clip, due to its resiliency, can exert a holding force upon the part or portion of the support structure.

Figure 6:
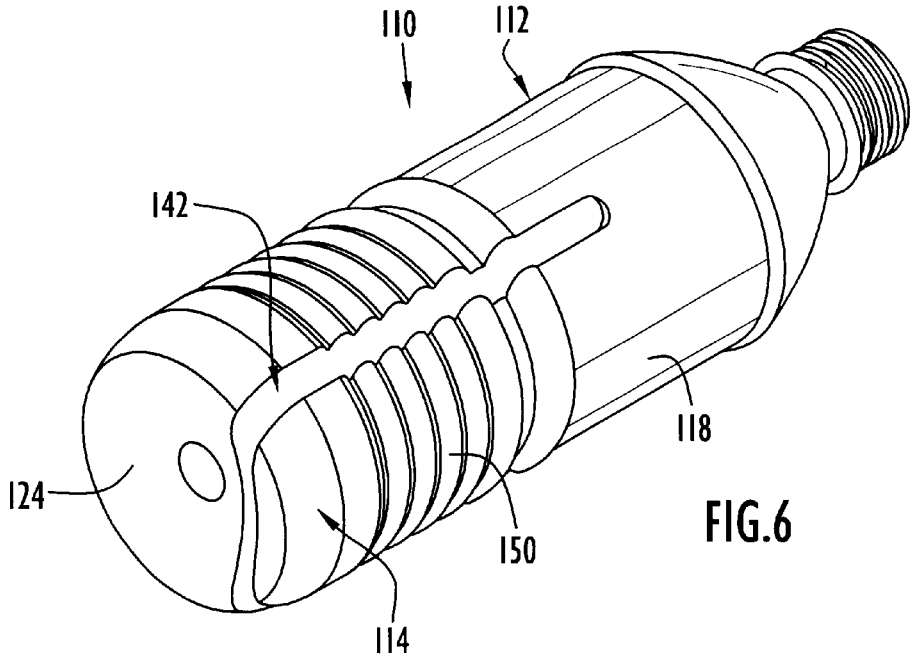
FIG. 6 is a perspective view of an alternative bottle according to the present invention.

An alternative bottle according to the present invention is illustrated in FIG. 6 at 110. The bottle 110 has a body 112 of generally cylindrical configuration and a clip 114 formed by an off axis slot 142 formed in the bottle 110 along a chord extending upwardly from the closed lower end of the bottle and terminating approximately ⅔ of the length of the bottle. The slot 142 has an open slot end along the bottom wall 124, a closed slot end on the intermediate section 118, and a length between the closed and open slot ends. The outer wall 150 of the clip forms part of the cylindrical external wall of the bottle body 112 and forms part of the external cylindrical configuration of the bottle. The clip 114 is hollow as described above for clip 14 such that contents with which the bottle is filled are disposed within the interior of the bottle body as well as the interior of the clip. The slot 142, which is longitudinally straight along its length, has a uniform or constant or a substantially uniform or constant depth D along its length, the depth being minimized so as not to subtract significantly from useable volume or capacity while being large enough to accept a part or portion of various support structures therein. The bottle 110 is integrally, unitarily formed of blow molded plastic.

The bottles according to the present invention are preferably made of blow molded plastic for manufacturing ease and efficiency as well as cost-effectiveness. The bottles are strong, lightweight and recyclable. Since the clips are formed integrally, unitarily with the bottle bodies, no extraneous parts or components are needed, and no steps need to be taken by consumers or purchasers prior to using the clips. The clips are hollow in order to accommodate contents therein so that volume or capacity for the bottles is maximized. The depth of the slots is minimized so as to maximize the size of the bottle interiors and, therefore, volumes. The bottles can be supported by gravity on various support structures by hanging the clips from such support structures. Parts or portions of various support structures can be frictionally held between the clips and the bottle bodies and/or the clips, due to their resiliency or flexibility, can exert a holding force on the parts or portions of the support structures. The clips are disposed within or form part of the external configurations of the bottles such that no protrusions are presented outside of or beyond the external configurations. The bottles are compatible with conventional package structure and packaging equipment and/or methods.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A bottle comprising a body of generally cylindrical external configuration and a clip joined to said body, said body having a closed lower end and an open upper end adapted to receive a cap, said clip having an outer wall forming part of said cylindrical external configuration and an inner wall spaced from a wall segment of said body to define a slot between said inner wall of said clip and said wall segment of said body adapted to receive part of a support structure upon which said bottle is to be supported, said clip having opposing sides, said outer and inner walls each extending laterally between said opposing sides, said slot extending laterally from one of said opposing sides to the other of said opposing sides.

2. A bottle as recited in claim 1 wherein said body includes a lower section of generally cylindrical external configuration, an upper section of dome-shaped external configuration and an intermediate section of cylindrical external configuration disposed between said upper and lower sections and said clip is disposed on said intermediate section.

3. A bottle as recited in claim 1 wherein said body includes a lower section of generally cylindrical external configuration, an upper section of dome-shaped external configuration and an intermediate section of cylindrical external configuration disposed between said upper and lower sections and said slot has a length extending from an open slot end adjacent said closed lower end of said body to a closed slot end disposed on said intermediate section.

4. A bottle as recited in claim 3 wherein said bottle includes a central longitudinal axis and said length of said slot extends parallel to said central longitudinal axis.

5. A bottle as recited in claim 1 wherein said body and said clip are formed integrally, unitarily of plastic.

6. A bottle comprising a body of generally cylindrical external configuration and a clip joined to said body, said body having a closed lower end and an open upper end adapted to receive a cap, said body including a lower section of generally cylindrical external configuration, an upper section of dome-shaped external configuration and an intermediate section of cylindrical external configuration disposed between said upper and lower sections, said clip being disposed on said intermediate section and having an outer wall forming part of said cylindrical external configuration of said intermediate section and having an inner wall spaced from a wall segment of said body to define a slot between said inner wall of said clip and said wall segment of said body adapted to receive part of a support structure upon which said bottle is to be supported, said wall segment having an inward curvature and said inner wall of said clip following said inward curvature of said wall segment.

7. A bottle as recited in claim 6 wherein said slot has a length extending from an open slot end adjacent said lower section to a closed slot end adjacent said upper section.

8. A bottle as recited in claim 7 wherein said slot has a depth between said inner wall of said clip and said wall segment, said depth being substantially uniform along said length of said slot.

9. A bottle comprising a body of generally cylindrical external configuration and a clip joined to said body, said body having a closed lower end and an open upper end adapted to receive a cap, said clip being disposed within said cylindrical external configuration and being spaced from a wall of said body to define a slot between said clip and said wall of said body adapted to receive a portion of a support structure upon which said bottle is to be supported, said slot having a depth between said clip and said wall of said body, said clip having a length and said depth of said slot being substantially uniform along said length of said clip, said clip having a width and said slot extending laterally the entire width of said clip.

10. A bottle as recited in claim 9 wherein said slot is longitudinally straight along said length of said clip.

11. A bottle as recited in claim 10 wherein said body includes a lower section of generally cylindrical external configuration, an upper section of dome-shaped external configuration and an intermediate section of cylindrical external configuration disposed between said upper and lower sections and said slot has a length extending from an open slot end adjacent said closed lower end of said body to a closed slot end disposed on said intermediate section.

12. A bottle as recited in claim 9 wherein said clip includes an outer wall forming part of said cylindrical external configuration.

13. A bottle comprising a body of generally cylindrical external configuration and a clip joined to said body, said body having a closed lower end and an open upper end adapted to receive a cap, said clip being disposed within said cylindrical external configuration and being spaced from a wall of said body to define a slot between said clip and said wall of said body adapted to receive a portion of a support structure upon which said bottle is to be supported, said slot having a depth between said clip and said wall of said body, said clip having a length and said depth of said slot being substantially uniform along said length of said clip, said slot being longitudinally curved along said length of said clip.

14. A bottle as recited in claim 13 wherein said body includes a lower section of generally cylindrical external configuration, an upper section of dome-shaped external configuration and an intermediate section of cylindrical external configuration disposed between said upper and lower sections and said slot is formed in said intermediate section and has a length extending from an open slot end adjacent said lower section to a closed slot end adjacent said upper section.

15. A plastic bottle comprising a body of generally cylindrical external configuration and a clip joined to said body, said body having a closed lower end and an open upper end adapted to receive a cap, said body having an interior, said clip having an outer wall forming part of said external configuration, an inner wall and opposing sides, said inner wall being spaced from a wall segment of said body to define a slot between said inner wall and said wall segment adapted to receive part of a support structure upon which said bottle is to be supported, said inner wall and said slot each extending laterally from one of said opposing sides to the other of said opposing sides, said clip being hollow and having an interior communicating with said interior of said body whereby contents with which said bottle is filled are disposed in said interior of said body and said interior of said clip.

16. A plastic bottle as recited in claim 15 wherein said clip is disposed within said cylindrical external configuration of said body.

17. A plastic bottle as recited in claim 16 wherein said outer wall forms part of said cylindrical external configuration.

18. A plastic bottle as recited in claim 17 wherein said slot has an open slot end along the exterior of said bottle allowing part of a support structure to be inserted between said clip and said wall segment of said body to support said bottle upon the support structure.

19. A plastic bottle as recited in claim 18 wherein said slot has a depth between said clip and said wall segment of said body and a length extending from said open slot end to a closed slot end, said depth being uniform along said length of said slot.

20. A plastic bottle as recited in claim 19 wherein said body and said clip are formed integrally, unitarily of blow molded plastic.

* * * * *